US010453317B2

(12) United States Patent
Lai

(10) Patent No.: US 10,453,317 B2
(45) Date of Patent: Oct. 22, 2019

(54) ANTI-THEFT HANGTAG

(71) Applicant: ROTE MATE INDUSTRY CO., LTD., Taichung (TW)

(72) Inventor: Ying-Tsung Lai, Taichung (TW)

(73) Assignee: ROTE MATE INDUSTRY CO., LTD., Taichung (TW)

( * ) Notice: Subject to any disclaimer, the term of this patent is extended or adjusted under 35 U.S.C. 154(b) by 0 days.

(21) Appl. No.: 15/792,724

(22) Filed: Oct. 24, 2017

(65) Prior Publication Data

US 2019/0057590 A1 Feb. 21, 2019

(30) Foreign Application Priority Data

Aug. 18, 2017 (TW) ..... 106128015 A

(51) Int. Cl.

| | |
|---|---|
| ***G08B 13/24*** | (2006.01) |
| ***E05B 73/00*** | (2006.01) |
| ***B65D 73/00*** | (2006.01) |
| *G08B 29/18* | (2006.01) |

(52) U.S. Cl.

CPC ..... *G08B 13/2434* (2013.01); *B65D 73/0064* (2013.01); *E05B 73/0017* (2013.01); *B65D 2211/00* (2013.01); *G08B 29/181* (2013.01)

(58) Field of Classification Search

CPC ..... G08B 13/2434; B65D 73/0064; B65D 2211/00; E05B 73/0017

See application file for complete search history.

(56) References Cited

U.S. PATENT DOCUMENTS 5,740,911 A * 4/1998 Chou ..... A47F 5/0861 206/1.5
5,979,652 A * 11/1999 Rosler ..... B65D 73/0064 206/349
6,273,255 B1 * 8/2001 Rosler ..... B65D 73/0064 206/378
6,425,482 B1 * 7/2002 Chiang ..... G03F 7/0758 206/349
6,634,501 B2 * 10/2003 Su ..... B25H 3/003 206/1.5
6,637,591 B2 * 10/2003 Chen ..... B65D 73/0014 206/349
7,124,900 B2 * 10/2006 Hu ..... B65D 73/0064 211/70.6
7,210,663 B2 * 5/2007 Wheeler ..... A47F 5/0006 206/349
7,624,865 B2 12/2009 Pendergraph et al.
7,779,658 B2 * 8/2010 Matsushita ..... E05B 37/025 70/30
8,864,097 B2 * 10/2014 Wang ..... F16M 13/005 206/349
9,604,771 B1 * 3/2017 Chen ..... B25H 3/003

(Continued)

*Primary Examiner* — Adnan Aziz

(74) *Attorney, Agent, or Firm* — Raymond Y. Chan; David and Raymond Patent Firm

(57) ABSTRACT

An anti-theft hangtag is revealed. The anti-theft hangtag is used for packing tools with circular grooves. The hangtag includes a hanging portion and a mounting portion. The mounting portion consists of a receiving portion and anti-theft members. The antitheft members are arranged at one end of the receiving portion with an opening. The antitheft members are used to clamp the tool and preventing the tool from being removed from the hangtag.

14 Claims, 10 Drawing Sheets

(56) References Cited

U.S. PATENT DOCUMENTS

| | | | | |
|---|---|---|---|---|
| 2007/0034771 | A1* | 2/2007 | Liu | A47F 5/0006 248/682 |
| 2007/0193313 | A1* | 8/2007 | Tsai | B65D 73/0064 70/57.1 |
| 2015/0209956 | A1* | 7/2015 | Hu | B65D 73/0064 206/349 |
| 2016/0016712 | A1* | 1/2016 | Su | B25H 3/04 206/349 |
| 2018/0065792 | A1* | 3/2018 | Chen | B25H 3/003 |
| 2018/0072475 | A1* | 3/2018 | Su | A47F 5/0861 |

* cited by examiner

ANTI-THEFT HANGTAG

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a hangtag, especially to a hangtag used for packaging tools with circular grooves. The tools include drivers, driver bits, drive bit holders, and so on.

Description of Related Arts

The package of many tools displayed on the hypermarket is exposed so that users can see and touch the products clearly. Such package is designed into a hanging type for being hung on the wall or on the extension rod/or hook of the display cabinet conveniently. Thus the package is called a hangtag. The hangtag consists of a surface with identification label, a holder for retaining products, and a hanging end for placing the hangtag on the hole of the extension rod/or hook. Generally the hangtag is used to package many products such as long tools for exposing and showing the products. However, one of the most serious problems the retailers that sell the products face is that consumers may remove the products from the hangtag or replace the package of the product. Thus anti-theft devices for preventing unauthorized access to the products are designed by manufacturers.

SUMMARY OF THE PRESENT INVENTION

Therefore it is a primary object of the present invention to provide an anti-theft hangtag that clamps a tool for preventing the tool from being released therefrom. The anti-theft hangtag includes a receiving portion that is able to be inserted through by a hexagonal handle of a tool such as driver. The receiving portion is disposed with a passage whose cross section is hexagonal, matched with a hexagonal handle of the tool/driver. The cross section can also be polygonal. The passage of the receiving portion of the anti-theft hangtag allows the handle of the tool to pass through and the polygonal design thereof prevents the tool/driver from being rotated. Moreover, the anti-theft hangtag further includes support parts and head parts formed by extension of the support parts. The tool/product is unable to be released from the hangtag due to the head parts that are mounted in a circular groove of the tool/driver for clamping the tool/driver.

In order to achieve the above object, an anti-theft hangtag according to the present invention is used for packing tools and including a hanging portion and a mounting portion formed by extension of one end of the hanging portion. The tool includes a handle having a hexagonal cross section and a circular groove disposed on one end of the handle. The mounting portion consists of a receiving portion and at least two antitheft members. The receiving portion is arranged with a passage whose cross section is hexagonal. The antitheft members are extended from the mounting portion and formed over an opening of the receiving portion. The antitheft member is composed of at least one support part, a concave part disposed on the support part and a head part formed by extension of the support part. The receiving portion allows the tool to pass through the passage thereof and keep moving upward until the head parts of the antitheft members are against the circular groove of the tool. Thereby the antitheft members prevent the tool from being released from the receiving portion while being removed downward. Moreover, the hexagonal passage of the receiving portion prevents rotation of the tool for protecting the tool from being turned away from the hangtag and further being removed from the hangtag.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
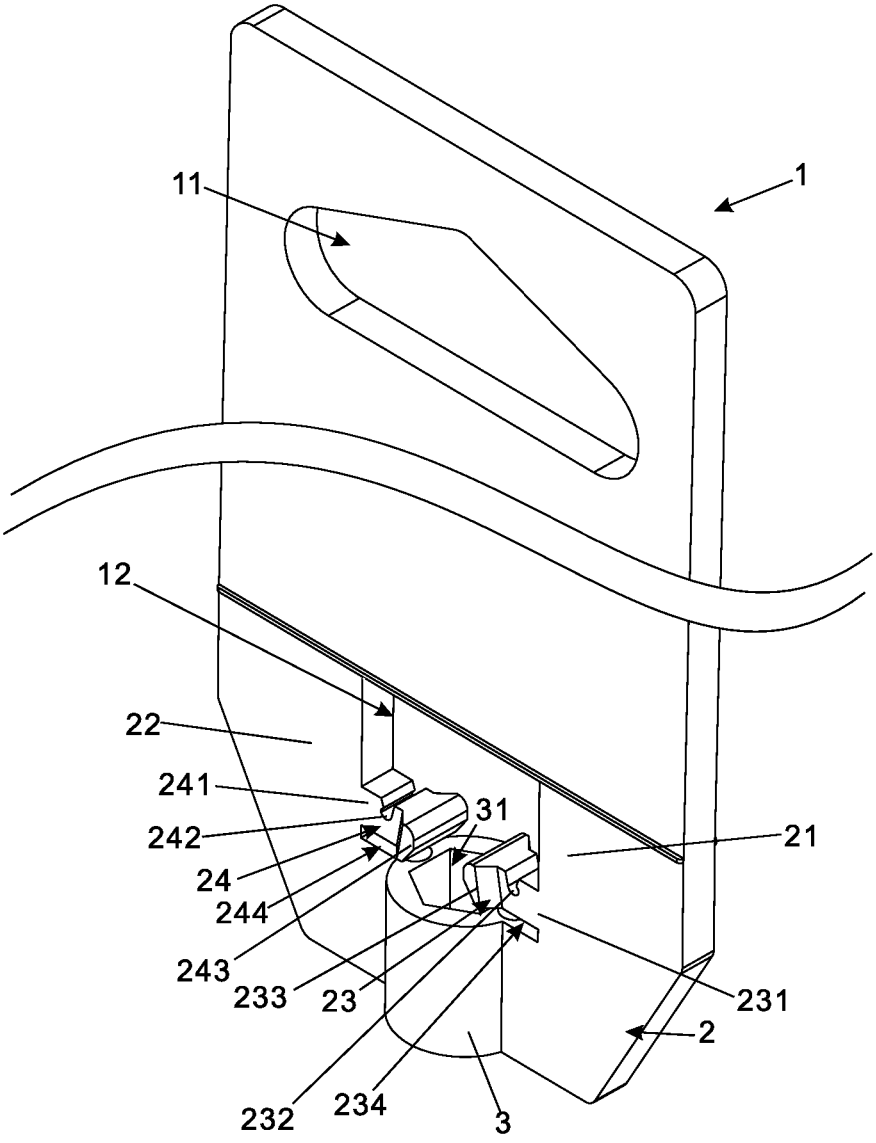
FIG. 1 is a perspective view of an embodiment according to the present invention.

Refer to FIG. 1, an embodiment of the present invention is a package hangtag designed for retaining and displaying tools such as drivers. The tool/driver includes a hexagonal handle and a circular groove disposed on one end of the handle. The present invention combines an anti-theft device that prevents the tool/driver from being removed with a hangtag used for packaging the driver tool.

As shown from FIG. 1 to FIG. 5, a hangtag includes a hanging portion 1 and a mounting portion 2 extended from one end of the hanging portion 1. The mounting portion 2 consists of two wing portions 21, 22 extended from one end of the hanging portion 1 and at least two antitheft members 23, 24 corresponding to each other and extended from one end of the wing portions 21, 22 respectively. An accommodation space 12 is formed between the two wing portions 21, 22. A receiving portion 3 is formed by extension of the wing portions 21, 22 toward a lower end of the antitheft members 23, 24 respectively. The antitheft member 23/24 is composed of a support part 231/241 formed by extension of one end of the wing portion 21/22, a concave part 232/242 formed by extension of the support part 231/241 and a head part 233/243 formed by extension of the concave part 232/242. A hollow passage 31 is formed axially on the receiving portion 3 and a cross section of the passage 31 can be hexagonal. The width of the passage 31 is a bit larger than the width of a cross section of a handle of a tool 5 such as a driver or the shape of the passage 31 and the shape of the handle of the tool 5 are matched. Thus the handle of the tool 5 can be inserted into the passage 31, passed through the passage 31 and reached the antitheft members 23, 24. The polygonal design of the passage 31 is for preventing the handle of the tool 5 from being rotated. The head part 233/243 is extended over an opening of the receiving portion 3.

Figure 3:
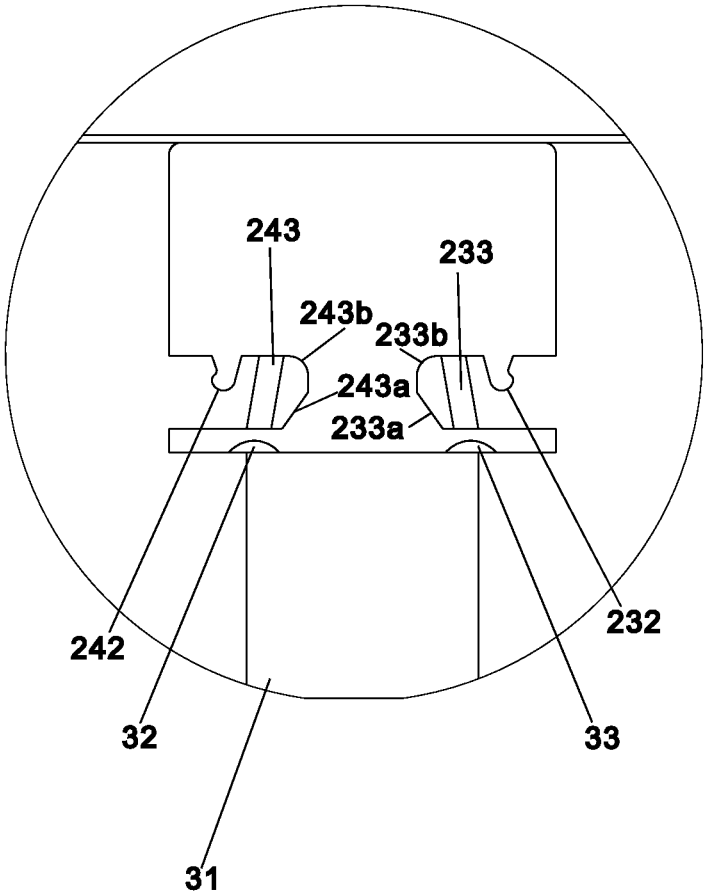
FIG. 3 is a partial enlarged view of a mounting portion of an embodiment according to the present invention.

As shown in FIG. 3, in the sectional view, the head part 233 of the antitheft member 23 includes a ramp 233*a* with a negative slope, a vertical surface formed by upward extension of the ramp 233*a*, a curved surface 233*b* and a horizontal surface extended from the curved surface 233*b* while the head part 243 of the antitheft member 24 includes a ramp 243*a* with a positive slope, a vertical surface formed by upward extension of the ramp 243*a*, a curved surface 243*b* and a horizontal surface extended from the curved surface 243*b*. Then the curved surface 233*b* is further extended to form a plane. A channel with a narrow top and a wide bottom is formed between the ramp 233*a* on one end of the head part 233 and the ramp 243*a* on one end of the head part 243. As to the concave part 232/242, it is formed on an upper end of an extension of the support part 231/241. The concave part 232/242 is a curved concave located on an upper end of the antitheft member 23/24, formed by extension of one end of the support part 231/241. The support part 231/241 is further extended upward to form the head part 233/243.

Figure 2:
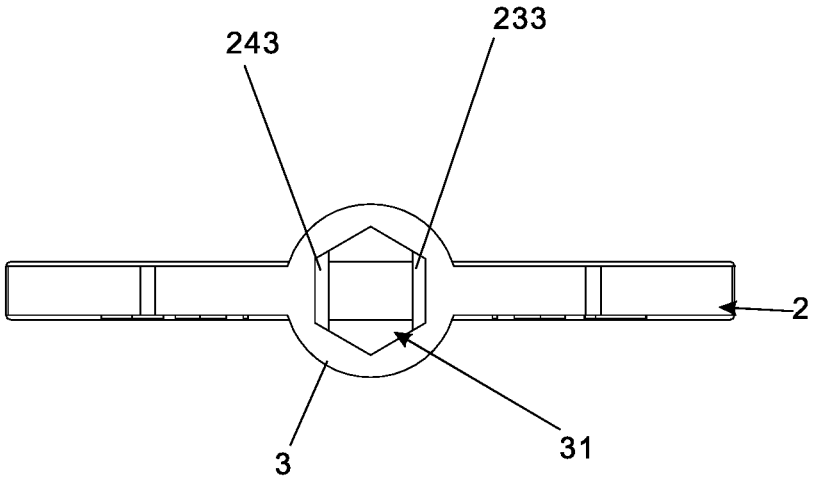
FIG. 2 is a bottom view of an embodiment according to the present invention.
Figure 4:
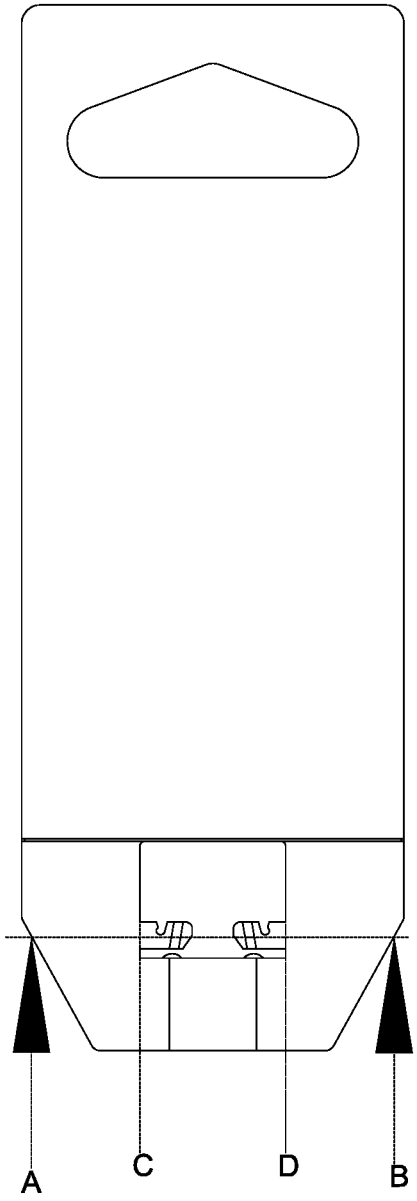
FIG. 4 is a front view of an embodiment according to the present invention.
Figure 5:
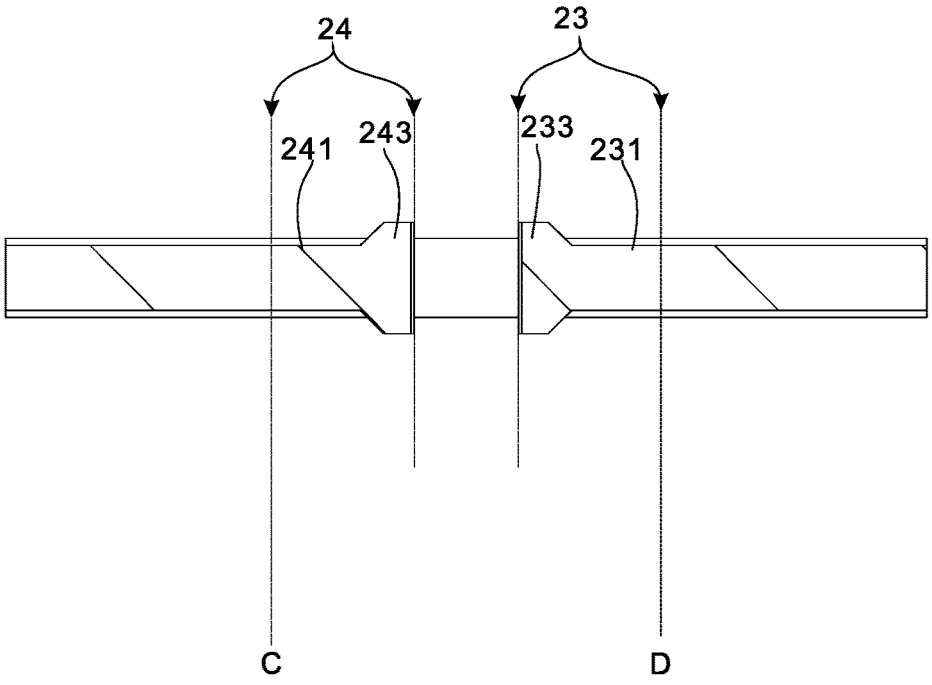
FIG. 5 is a cross sectional view along line AB in FIG. 4 of an embodiment according to the present invention.
Figure 6:
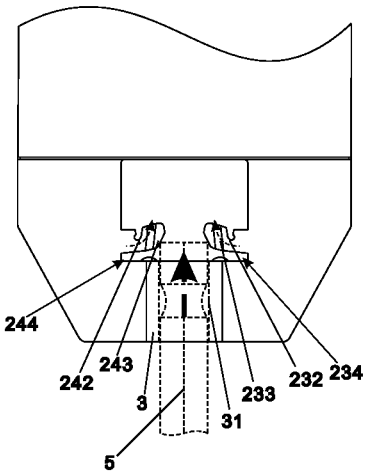
FIG. 6 is a schematic drawing showing an embodiment in use according to the present invention.

Refer to FIG. 4 and FIG. 5, the thickness of the support part 231/241 within the segment CD is smaller than that of the head part 233/243 within the segment CD while the segment CD refers to the distance from C to D in the figures. That means the support part 231/241 is extended from C and D to form the enlarged head part 233/243 with increasing thickness. The receiving portion 3 and the antitheft members 23, 24 are separated and a buffer space 234, 244 is formed therebetween. Refer to FIG. 3, two bumps 32, 33 are arranged beside two sides of an opening of the receiving portion 3 respectively. As shown in FIG. 2, the head parts 233, 243 are extended over the opening of the passage 31. Refer to FIG. 6, the receiving portion 3 is used for allowing the handle of the tool 5 to pass through the passage thereof and reach the antitheft members 23, 24. The top end of the tool 5 first pushes against the ramps 233*a*, 243*a* under the head parts 233 243. Then head parts 233 243 are easily deformed and bent upward owing to the design of the concave parts 232, 242 on an upper end of the antitheft members 23, 24. Thus the tool 5 is moved upward smoothly until the curved surfaces 233*b*, 243*b* on the head parts 233, 243 of the antitheft members 23, 24 are in contact with a circular groove 51 of the tool 5. Then the head parts 233, 243 turn back due to curved design of the concave parts 232, 242 to lean against the circular groove 51 of the tool 5.

Figure 7:
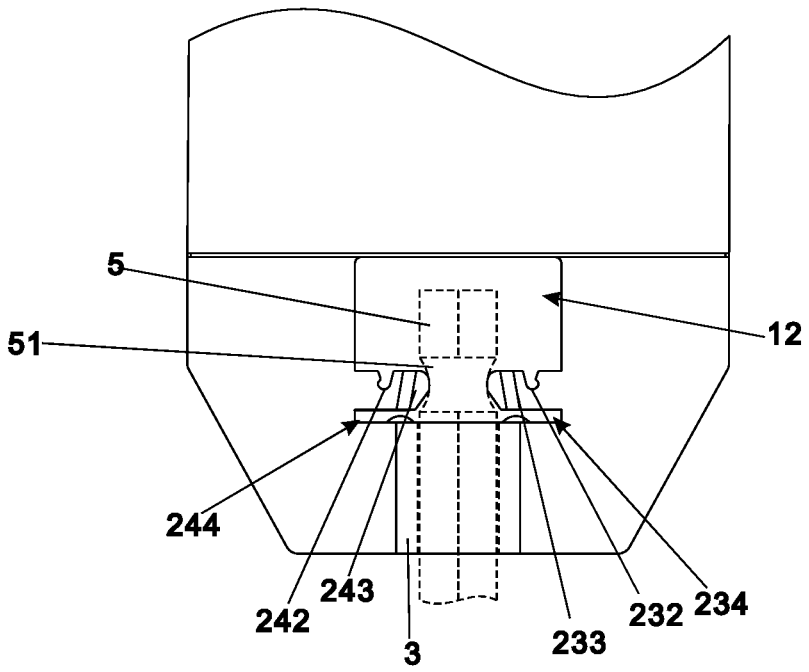
FIG. 7 is another schematic drawing showing another embodiment in use according to the present invention.
Figure 8:
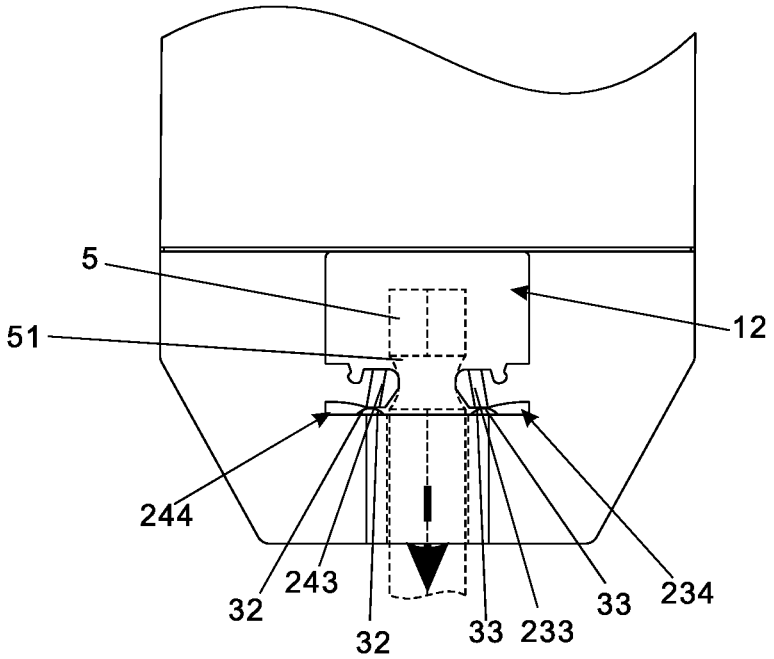
FIG. 8 is a further schematic drawing showing another embodiment in use according to the present invention.
Figure 9:
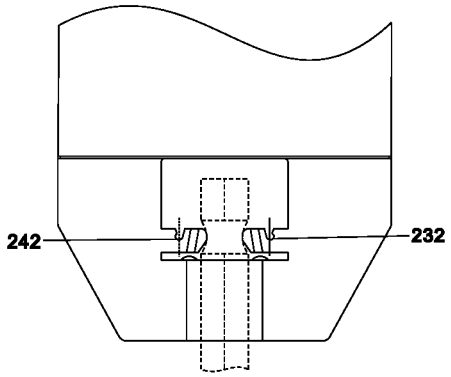
FIG. 9 is a further schematic drawing showing another embodiment in use according to the present invention.

Thereby the tool 5 will not be released from the receiving portion 3 while being moved downward. The hexagonal passage 31 of the receiving portion 3 prevents the tool 5 from being rotated. Thus the tool 5 is retained in the receiving portion 3, without being removed from the hangtag. As shown in FIG. 6, the head parts 233, 243 are mounted in the circular groove 51 of the tool 5 for clamping the tool 5 after one end of the handle of the tool 5 being passed through the passage 31. Thus the tool 5 is unable to be released from the hangtag. Refer to FIG. 7, the curved design of the concave parts 232, 242 makes the antitheft members 23, 24 have certain flexibility and elasticity. Thus the head parts 233, 243 can be bent upward within the buffer space 234, 244. Such design also provides support to the head parts 233, 243 while the head parts 233, 243 are being bent downward by an external force. Moreover, the bumps 32, 33 on the two sides of the opening of the receiving portion 3 also restricts deformation of the head parts 233, 243 while the head parts 233, 243 being pulled downward. Refer to FIG. 8, an upper part of the circular groove 51 presses against the head parts 233, 243 when the handle of the tool 5 is pulled downward axially by an external force. Thus the head parts 233, 243 are also pulled downward, bent and deformed. Yet the downward bent and deformation of the head parts 233 243 are limited because that the bumps 32, 33 are leaning against the head parts 233, 243. The curved surfaces 233*b*, 243*b* are pressed by the upper part of the circular groove 51 owing to the bit bent and deformation of the head parts 233 243. Thus the head parts 233 243 are more tightly clamped in the circular groove 51 of the handle of the tool 5. This prevents the tool 5 from being released from the receiving portion 3.

Figure 10:
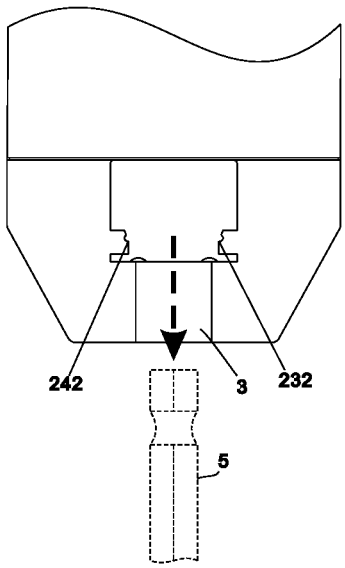
FIG. 10 is a further schematic drawing showing another embodiment in use according to the present invention.

Furthermore, the design of the concave parts 232, 242 allows users to release the tool 5 from the receiving portion 3 conveniently and quickly after the product being purchased. The user only needs to cut off the head parts 233, 243 through the concave parts 232, 242 by scissors, cutters or knives, as shown in FIG. 10. Thus the tool 5 is easy to be released from the receiving portion 3.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An anti-theft hangtag used for packing a tool with a circular groove comprising:

a hanging portion; and a mounting portion formed by extension of one end of the hanging portion and including a receiving portion arranged with a passage and at least two antitheft members;

wherein the tool includes a handle whose cross section is hexagonal and the circular groove is disposed on one end of the handle around an outer periphery thereof; a cross section of the passage of the receiving portion is hexagonal; the antitheft member includes a support portion extended from the mounting portion, a concave part formed by extension of the support part, and a head part formed by extension of the concave part; one end of the head part is extended over an opening of the passage of the receiving portion; the receiving portion allows the tool to pass through the passage thereof and keep moving upward until the head parts of the antitheft members are against the circular groove of the tool; thereby the tool will not be released from the receiving portion while being removed downward.

2. The device as claimed in claim 1, wherein a bump is arranged beside each of two sides of the opening of the receiving portion.

3. The device as claimed in claim 1, wherein the concave part is disposed on an upper end of the antitheft member.

4. The device as claimed in claim 1, wherein the head part includes a ramp, a vertical surface extended from the ramp, a curved surface and a horizontal surface extended from the curved surface in a sectional view thereof; the ramp is either with a negative slope or with a positive slope.

5. The device as claimed in claim 1, wherein a lower part of one end of the head part facing the other head part is a ramp with a positive/or negative slope and an upper part of one end of the head part facing the other head part is a curved surface.

6. The device as claimed in claim 1, wherein the concave part is a curved concave formed by extension of one end of the support part and the support part is further extended upward to form the head part.

7. The device as claimed in claim 1, wherein the support part is extended to form the enlarged head part.

8. The device as claimed in claim 1, wherein the receiving portion and the antitheft members are separated and a buffer space is formed therebetween.

9. An anti-theft hangtag used for packing a tool with a circular groove comprising:

a hanging portion; and a mounting portion formed by extension of one end of the hanging portion and including a receiving portion arranged with a passage and at least two antitheft members;

wherein the tool includes a handle whose cross section is hexagonal and the circular groove is disposed on one end of the handle around an outer periphery thereof; a cross section of the passage of the receiving portion is hexagonal; a bump is arranged beside each of two sides of an opening of the passage of the receiving portion; the antitheft members are extended from the mounting portion and formed over the opening of the passage of the receiving portion; the antitheft member includes at least one support part, a concave part disposed on the support part and a head part formed by extension of the support part; the support part is extended to form the enlarged head part; the receiving portion allows the tool to pass through the passage thereof and keep moving upward until the head parts of the antitheft members are against the circular groove of the tool; thereby the tool will not be released from the receiving portion while being removed downward.

10. The device as claimed in claim 9, wherein the receiving portion and the antitheft members are separated and a buffer space is formed therebetween.

11. The device as claimed in claim 9, wherein the concave part is disposed on an upper end of the antitheft member.

12. The device as claimed in claim 9, wherein the head part includes a ramp, a vertical surface extended from the ramp, a curved surface and a horizontal surface extended from the curved surface in a sectional view thereof; the ramp is either with a negative slope or with a positive slope.

13. The device as claimed in claim 9, wherein a lower part of one end of the head part facing the other head part is a ramp with a positive/or negative slope and an upper part of one end of the head part facing the other head part is a curved surface.

14. The device as claimed in claim 9, wherein the concave part is a curved concave formed by extension of one end of the support part and the support part is further extended upward to form the head part.

* * * * *